US005960965A

United States Patent [19]

Saunders

[11] Patent Number: 5,960,965

[45] Date of Patent: Oct. 5, 1999

[54] PRODUCT DISPLAY SYSTEM

[76] Inventor: Todd R. Saunders, 15756 Margaret Ave., Spring Lake, Mich. 49456

[21] Appl. No.: 08/967,398

[22] Filed: Nov. 11, 1997

Related U.S. Application Data

[60] Provisional application No. 60/030,654, Nov. 12, 1996.

[51] Int. Cl.[6] ..... A47F 7/08

[52] U.S. Cl. ..... 211/35; 211/36; 211/90.01

[58] Field of Search ..... 211/35, 36, 99, 211/90.01, 94.01

[56] References Cited

U.S. PATENT DOCUMENTS

| | | | |
|---|---|---|---|
| D. 47,797 | 9/1915 | Moore | 211/36 X |
| 120,671 | 11/1871 | Schmidt | 211/99 |
| D. 361,003 | 8/1995 | Keller et al. | D6/449 |
| 925,182 | 6/1909 | Harvey | 126/39 C |
| 1,163,038 | 12/1915 | Robertson et al. | 211/35 |
| 1,386,775 | 8/1921 | Fulford | 211/35 X |
| 1,589,198 | 6/1926 | McComb | 211/36 X |
| 1,949,017 | 2/1934 | Knupp | 211/35 |
| 2,205,817 | 6/1940 | Kramb | 211/35 X |
| 2,409,268 | 10/1946 | Gerlich | 211/35 |
| 2,412,847 | 12/1946 | Tilburg | 211/35 |
| 2,457,445 | 12/1948 | Clair | 211/35 X |
| 2,682,955 | 7/1954 | Moore | 211/35 |
| 2,931,513 | 4/1960 | Cignoli | 211/35 |
| 3,032,905 | 5/1962 | Schultz | 40/553 |
| 3,563,390 | 2/1971 | Kim | 211/35 |
| 3,776,643 | 12/1973 | Titoff | 206/8 X |
| 4,383,722 | 5/1983 | Weber | 312/324 |
| 4,693,380 | 9/1987 | Muth | 211/35 |
| 4,736,996 | 4/1988 | Zeichner | 312/118 |
| 4,867,407 | 9/1989 | Becker | 248/444.1 |
| 5,137,240 | 8/1992 | Van Meter | 211/35 X |
| 5,384,198 | 1/1995 | Hodges | 248/466 |
| 5,636,751 | 6/1997 | Frank | 211/36 |
| 5,645,178 | 7/1997 | Conley, Jr. | 211/87.01 |
| 5,746,332 | 5/1998 | Kleinschmidt | 211/153 |
| 5,749,480 | 5/1998 | Wood | 211/99 X |

*Primary Examiner*—Daniel P. Stodola
*Assistant Examiner*—Erica B. Harris
*Attorney, Agent, or Firm*—Factor and Shaftal

[57] ABSTRACT

A product display system having a backing plate which supports both a product support member and a reflective member. In the preferred embodiment, the backing plate is mounted to a supporting vertical wall and the support member and reflective member project outwardly therefrom. The support member is adapted to support a product such as an athletic shoe and the reflective member is adapted to reflect one surface of the shoe such as the sole, which may not easily be observed absent removing the shoe from the display.

10 Claims, 3 Drawing Sheets

PRODUCT DISPLAY SYSTEM

This application claims the benefit of U.S. Provisional Application Ser. No. 60/030,654 filed Nov. 12, 1996.

BACKGROUND OF THE INVENTION

1. Field of the Invention

This invention relates to a product display and, more particularly, to a display system adapted to show or exhibit both the top and bottom surfaces of the product, for example, athletic shoes.

2. Description of the Related Art

In today's competitive economy, effective product displays become more important in promoting and selling products. One particular area in which product display has become critical is the sale of athletic shoes. For several years, logos, designs, and colors provided on the top of athletic shoes have been vital to effective marketing of the products. More recently, graphics, logos, and other designs which are incorporated into the bottom or sole of the shoe have also been critically important. The prior art displays do not provide any mechanism for effectively, simultaneously displaying the soles and the upper portion of shoes. The display system according to the invention overcomes these problems without dramatically impacting the space required to display the shoe products.

BRIEF DESCRIPTION OF THE DRAWINGS

The invention will now be described with reference to the drawings in which.

DETAILED DESCRIPTION OF THE PREFERRED EMBODIMENTS

Figure 1:
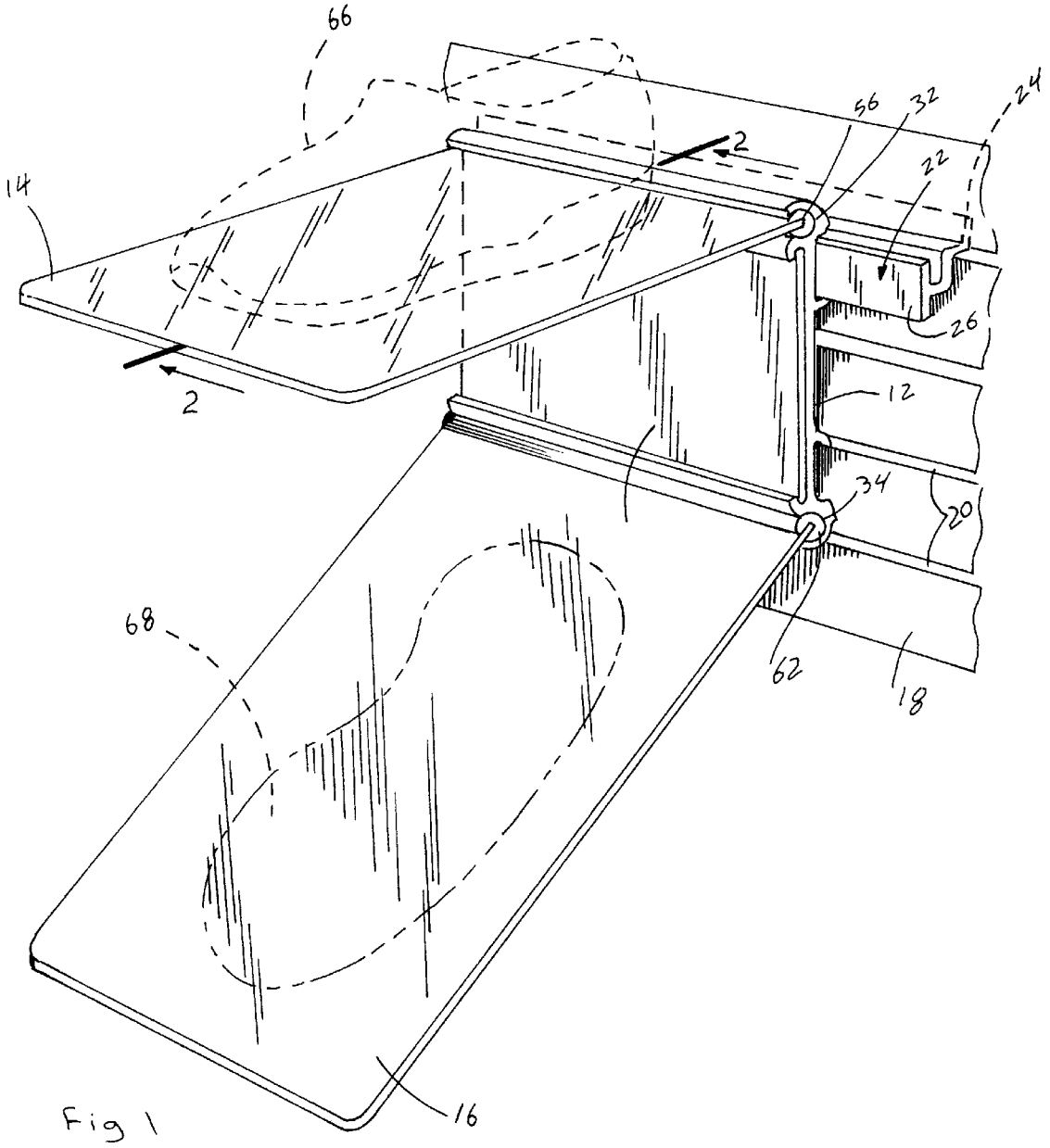
FIG. 1 is a perspective view of a first embodiment of the product display system according to the invention showing the display system mounted to a conventional wall structure.
Figure 2:
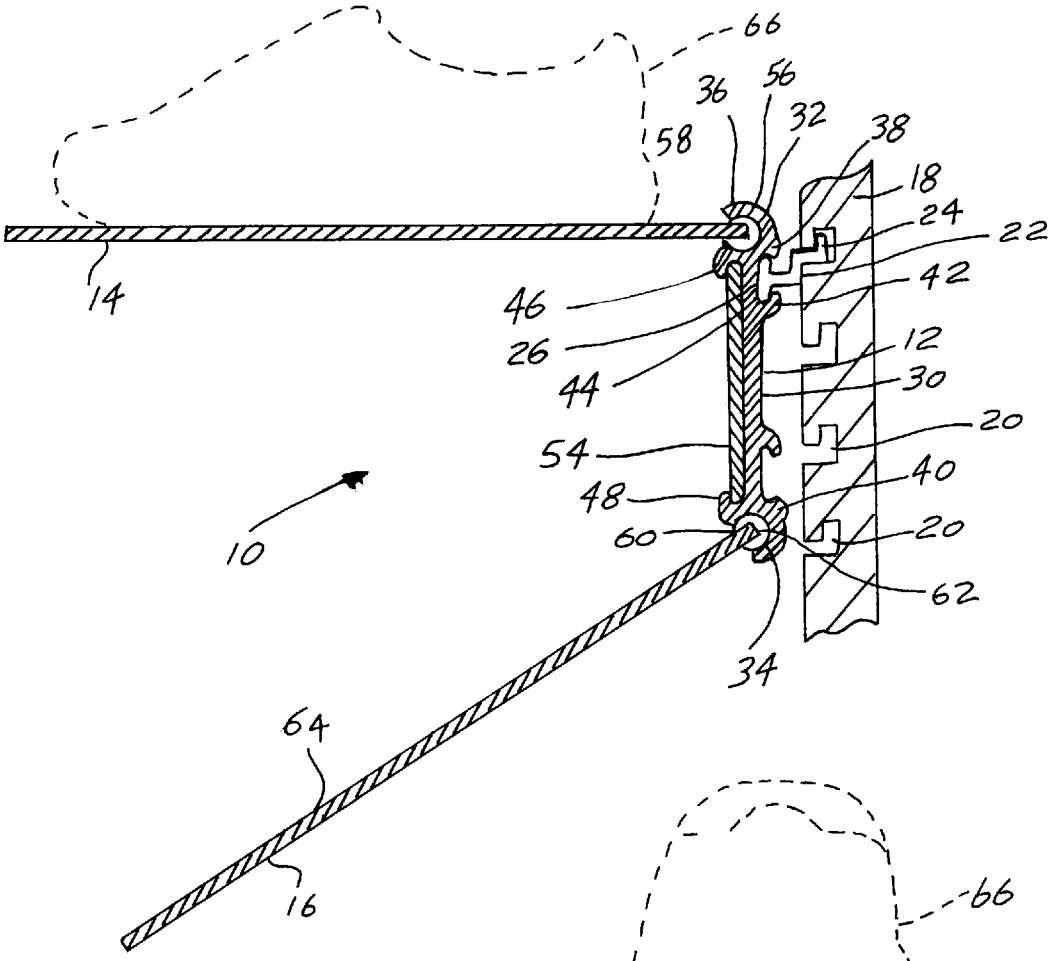
FIG. 2 is a cross-sectional view taken along lines 2—2 of FIG. 1.

Turning now to the drawings and to FIGS. 1 and 2 in particular, a first embodiment of a product display system 10 according to the invention is shown. In this embodiment, the display system comprises a mounting member or backing plate 12, a support member 14 mounted to the backing plate 12, and a reflective member 16 also mounted to the backing plate 12. Preferably, the support member 14 is transparent such as glass or plexiglass. The product display system 10 according to the invention is ideally suited for mounting to a conventional slotted wall structure 18 which includes multiple L-shaped slots 20 adapted to receive a mounting bracket 22. One end of the bracket is L-shaped 24, complimentary to the slot. The other end of the bracket is T-shaped 26 and, as described further below, is adapted to be mounted to the support member 14.

The backing plate 12 comprises a substantially planar plate 30 having a first channel 32 formed at the top of the plate 30 and a second channel 34 provided at the bottom of the plate 30. Each of the channels are defined by a substantially circular outer wall 36 which is integrally formed into the backing plate. Tapped holes are provided in the circular outer wall 36 and are adapted to receive set screws 38, 40 which will be described further below. The rear surface of the backing plate 30 further comprises at least one retention flange 42 which cooperates with the circular outer wall 36 of the channel 32 to define a groove 44 for slidably receiving the T-shaped end 26 of the mounting bracket 22. In practice, the plate 30 is slidably mounted to the mounting bracket 22 which is then mounted to the slotted wall structure 18 by inserting the L-shaped end 24 of mounting bracket 22 into one of the L-shaped slots 20. The cooperating mounting bracket 22 and slotted wall structure 18 are the preferred method for supporting the backing plate. However, the backing plate could be mounted to a supporting wall by any conventional means.

Figure 3:
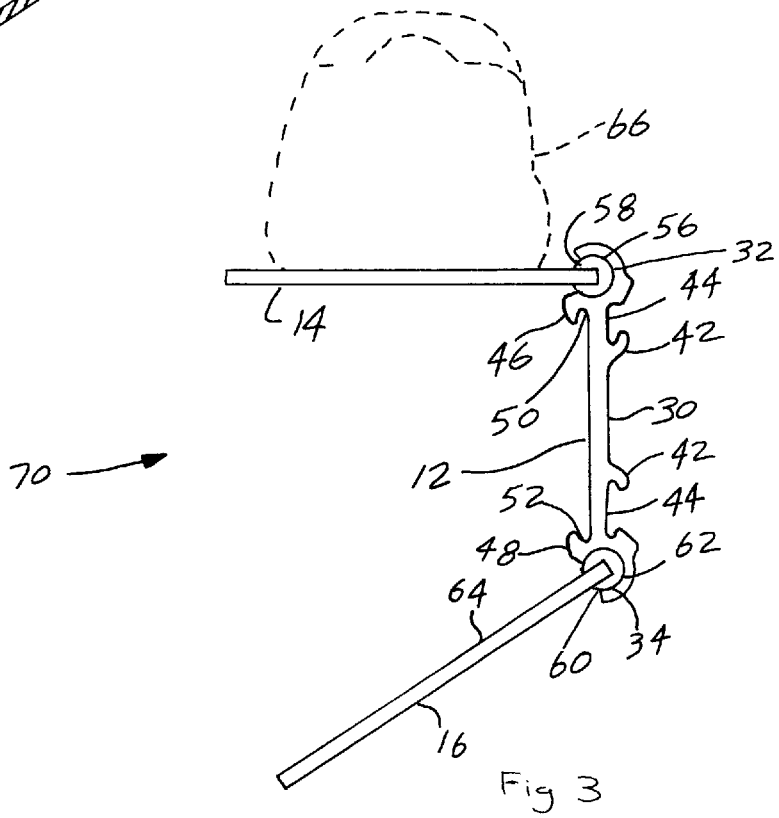
FIG. 3 is a side-elevational view of a second embodiment of the product display system according to the invention.

The front surface of the plate 30 includes a pair of opposed display sign flanges 46, 48 which, in cooperation with the circular outer wall 36 of the channels 32, 34 and front surface of the plate 30, define a pair of display sign grooves 50, 52. The grooves are adapted to slidably receive a display sign 54. The sign can take the form of graphics, a mirror surface, sales tag, product information, or the like. FIGS. 1 and 2 show the display sign 54 mounted in the opposed grooves 50, 52. However, as shown in FIG. 3, there is no need to include the display sign.

As seen in FIGS. 1 and 2, the support member 14 is substantially planar and has a boss 56 provided on one end thereof. Preferably, the boss 56 is complementary to the interior surface of the first channel 32. The boss 56, support member 14, and the opening 58 of the first channel 32 are dimensioned so that the boss 56 is slidably received in the channel 32 and the support plate extends through the opening 58 of the first channel, but the boss 56 is larger than the opening 58, thereby preventing removal of the support member and boss 56, except for sliding movement parallel to the axis of the first channel.

In the preferred embodiment, the boss 56 and the first channel 32 are substantially circular in cross section so that the relative angle of the outwardly extending support member 14 relative to the backing plate 12 can be quickly and easily adjusted. The set screw 38 is adapted to frictionally engage the boss 56 and hold the boss and support member 14 in a desired angular orientation with respect to the backing plate 12. With the set screw 38 rotated such that it does not engage the boss 56, the support plate 14 can be rotated through a wide range of suitable orientations. Once the desired angular orientation of the support plate 14 with respect to the backing plate 12 and wall 18 has been reached, the set screw is tightened to frictionally engage the boss 56.

The reflective member 16 similarly has a boss 62 provided on one end thereof which is rotationally mounted in the second channel 34 and frictionally retained in a particular angular orientation through the set screw 40. Similar to the support member 14, the reflective member 16, boss 62, channel 34, and channel opening 60 are dimensioned to permit various angular orientations of the reflective member to the backing plate 12, wall, and support member 14.

The particular display application which the product display system 10 according to the invention is ideally suited for is displaying footwear, specifically, athletic shoes 66. Preferably, the support member 14 is formed from a transparent plastic material, and preferably, the reflective member 16 has a reflective surface 64 provided thereon. Therefore, as a shopper stands in front of the product display system 10, he can easily observe the top surface of the shoe 66 supported on the support member 14, and by looking at the reflective surface 64 of the reflective member 16, the shopper can easily observe the reflection of the shoe sole 68. In other words, the shopper can easily observe both the top and bottom surfaces of the product positioned on the support member 14 without removing the shoe 66 from the display. Simultaneous with this, additional signage or display materials can be positioned in the display sign grooves 50, 52. With the product display system according to the invention, the angular orientation of the support member 14 and reflective member 16 can be quickly and easily altered depending upon the position of the product display system 10 along the wall height and the anticipated position of shoppers. When the product display is positioned near the bottom of a wall 18, the angle between the plate 30 and the reflective member 16 approaches 90°. For those product display systems positioned near the top of the wall 18, the relative angle between the reflective member 16 and the plate 30 is significantly greater than 90° but does not exceed 180°. Although the preferred embodiment shows the support member 14 positioned above the reflective member 16, in some circumstances, such as when the product is positioned very high on the support wall, it may be appropriate to reverse this orientation so that the reflective member 16 reflects down to the observer the top surface of the athletic shoe 66 rather than the bottom surface. In the orientation, the bottom surface would be clearly visible through the support member 14, assuming that the support member were transparent.

FIG. 3 shows a second embodiment of the product display system 70 according to the invention. In this embodiment, the lengths of the support member 14 and reflective member 16 has been reduced, but the width has been increased to accommodate the shoe 66 which has been rotated 90° from the orientation as seen in FIG. 1. In this embodiment, the product display system 10 will necessitate additional wall space but similarly will not extend outwardly as far from the wall as required by the system seen in FIG. 1. In addition, the second embodiment of the product display system 70 does not include a display sign 54 as seen in the embodiment shown in FIG. 1. As noted above, the incorporation of a display sign 54 is optional.

Figure 4:
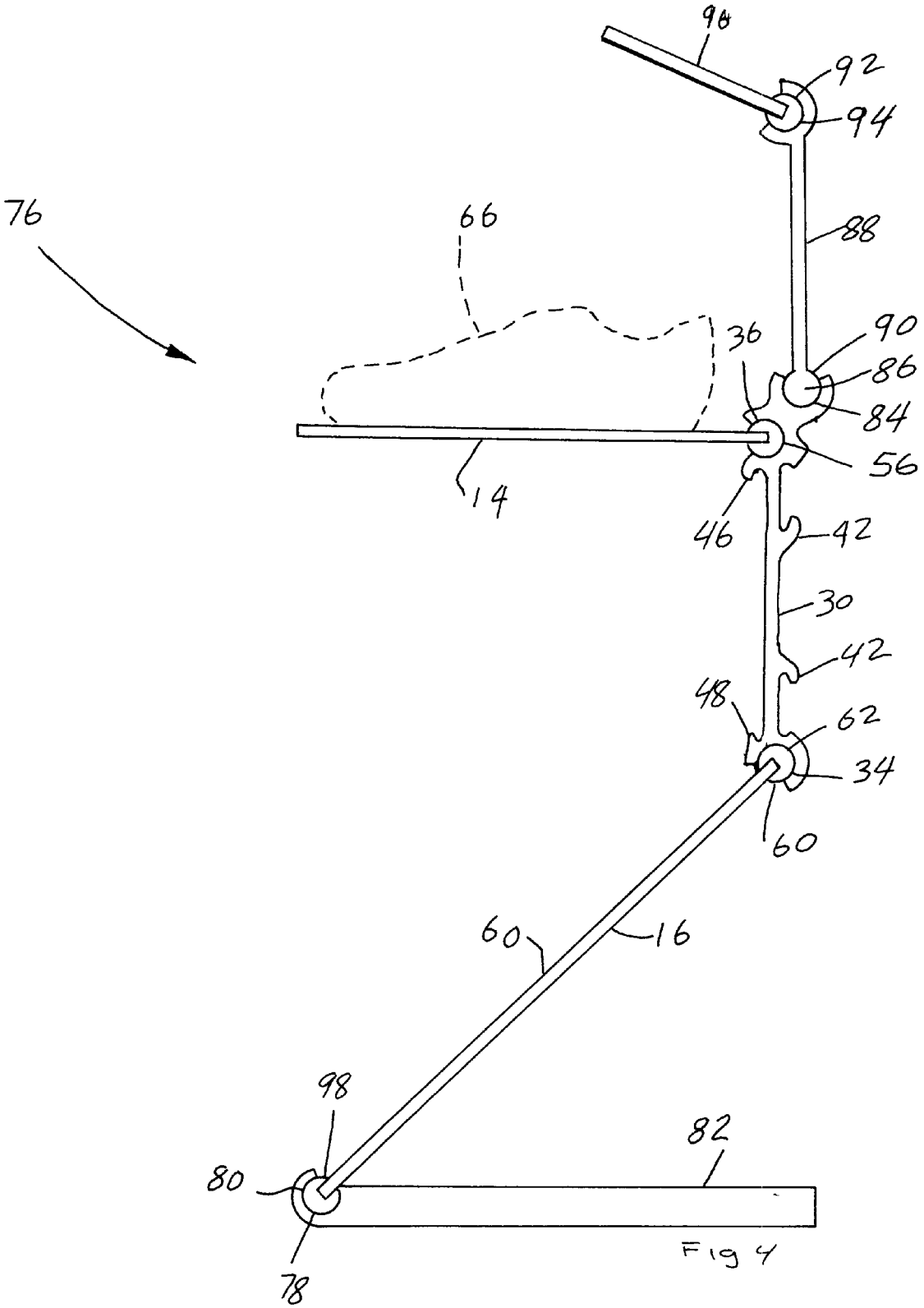
FIG. 4 is a side-elevational view of a third embodiment of the product display system according to the invention.

FIG. 4 shows a third embodiment of the product display system 76. As in the first embodiment, a product such as a shoe 66 is supported on the support member 14 which is, in turn, slidably mounted in the first channel 32 of the backing plate 12. Similarly, the boss 62 of the reflective member is slidably received in the second channel 34 of the plate 30. In the third embodiment, a second boss 78 is provided at the terminal end of the reflective member 16. This boss 78 is slidably received in a complementary channel 80 formed in a base 82. Similar to the other earlier embodiments, the boss 78 is frictionally retained in the groove 80 by a set screw (not shown), and the angular orientation of the reflective member 16 with respect to the base 82 can be quickly and easily altered depending upon the size of the channel opening 98. The base 82 comprises a planar member which is adapted to rest upon the floor or other horizontal surface. Preferably, the base 82 is weighted to provide sufficient stability for the product display 76. Through the incorporation of the base 82, the product display 76 is freestanding and need not be mounted to any support wall. This provides flexibility regarding the positioning of the product display 76 within the store while retaining the benefits of being able to display the reflection of the bottom surface of the shoe 66 or other product mounted on the support member 14.

The third embodiment of the product display 76 can be further modified by providing means for a reflective display on the top of the product. Preferably, this is accomplished by integrally forming a third channel 84 into the backing plate 12. Preferably, the third channel 84 is circular in cross section and receives a complementary boss 86 provided on the end of a plate 88. As in the other embodiments, the boss 86 is frictionally retained in the third channel 84 by a set screw (not shown), and the opening 90 of the channel 84 is large enough so that the angular orientation of the plate with respect to the backing plate 12 can be altered. The upper end of the plate 88 has a fourth channel 92 integrally formed therein which is adapted to slidably receive a boss 94 provided on one end of a second reflective member 96. As in earlier embodiments, the boss 94 is retained in the channel 92 by a set screw, and the opening of the channel is dimensioned to permit angular adjustments of the second reflective member 96 with respect to the upper plate 88.

Incorporating the second reflective member 96 provides yet another way to easily, simultaneously display both the top and bottom surfaces of a product. Once again, the ability to alter the angles of the support member 14, first reflective member 16, backing plate 12, upper plate 88, base 82, and second reflective member 96 with respect to one another provides nearly unlimited applications and modifications of the product display system 76 according to the invention.

A person skilled in the art will appreciate that the present invention extends to a wide variety of reflective product displays which, although ideally suited for use with athletic shoes, can be adapted for use with virtually any product in which observation by the consumer of more than one surface of the product is desired. Reasonable variation and modification are possible within the spirit of the foregoing specification and drawings without departing from the scope of the invention.

What is claimed is:

1. A product display system comprising:

a mounting member having first and second support channels provided thereon;

a substantially transparent product support member having a support surfaces located on a first side there of, adapted to receive and support a product therein, and an edge, the edge being received in the first support channel of the mounting member; and a reflective member having a reflective surface and an edge, the edge of the reflective member being received in the second support channel of the mounting member, the reflective member being positioned in the second support channel on a second side of the product support member opposite the first side to permit an observer of the product display system to view the surface of the product received on the support surface, and wherein the edge of the reflective member includes a boss, the boss being substantially circular in cross section and the second support channel being substantially complementary to the boss.

2. A product display system according to claim 1 wherein the reflective member is pivotable within the second support channel of the mounting member by rotation of the substantially circular boss in the second support channel.

3. A product display system according to claim 2 and further comprising a set screw threadably mounted in the mounting member for movement between a locked position in which a first end of the screw bears against the boss and prevents rotation of the boss with respect to the mounting member and a retracted position in which the first end of the screw is retracted from the boss such that the boss can rotate in said second support channel.

4. A product display system according to claim 2 and further comprising a boss provided on said edge of the product support member, the boss being substantially circular in cross section and the first support channel being substantially complementary to said product support member boss.

5. A product display system according to claim 4 wherein the product support member is pivotable within the first support channel with respect to the mounting member by rotation of the substantially circular product support member boss in the first support channel.

6. A product display system according to claim 1 wherein the mounting member is mounted to a support wall.

7. A product display system according to claim 1 and further comprising a substantially horizontal base mounted to one of the reflective member, mounting member, and product support member, the base being configured to support the product display system on a substantially horizontal surface.

8. A shoe display comprising:

a support plate having first and second support channels provided thereon;

a substantially transparent shoe support member having a support surface located on a first side thereof, adapted to receive and support a shoe therein, and an edge, the edge being received in the first support channel of the support plate; and a reflective member having a reflective surface and an edge, the edge of the reflective member being received in the second support channel of the support plate, the reflective member being positioned in the second support channel on a second side of the shoe support member opposite the first side to permit an observer of the product display system to view the surface of the shoe received on the support surface.

9. A shoe display according to claim 8 wherein the shoe support member is positioned vertically above the reflective member and the reflective member is aligned with respect to the shoe support member to enable an observer of the shoe display to easily observe both the top and bottom surfaces of a shoe mounted on the shoe support member.

10. A shoe display system according to claim 9 wherein the reflective member is pivotably mounted to the support plate so that the relative angle of orientation between the shoe support member and the reflective member can be varied depending upon the desired shoe display.

* * * * *